United States Patent [19]

Hosterman et al.

[11] Patent Number: 4,757,941

[45] Date of Patent: Jul. 19, 1988

[54] VACUUM COIN COLLECTION APPARATUS

[76] Inventors: Douglas G. Hosterman, 1254 Fox Ave., Paris, Ohio 44669; Frank B. Hosterman, 644 Revolta Cir., Mesa, Ariz. 85201

[21] Appl. No.: 130,689

[22] Filed: Dec. 9, 1987

[51] Int. Cl.[4] ..... B65D 91/00

[52] U.S. Cl. ..... 232/16; 232/1 D; 232/43.2

[58] Field of Search ..... 232/1 D, 1 R, 16, 43.2; 406/170, 163, 50

[56] References Cited

U.S. PATENT DOCUMENTS

| | | | |
|---|---|---|---|
| 2,003,257 | 5/1935 | Fageol et al. | 406/112 |
| 3,263,943 | 8/1966 | Share et al. | 232/16 X |
| 3,419,209 | 12/1968 | Munn | 232/1 |
| 3,509,911 | 5/1970 | Carsey | 137/602 |
| 3,979,054 | 9/1976 | Graham | 232/16 X |
| 4,131,318 | 12/1978 | Deem | 406/170 |
| 4,679,700 | 7/1987 | Harrington et al. | 232/1 R X |

*Primary Examiner*—Robert W. Gibson, Jr.

*Attorney, Agent, or Firm*—Michael Sand Co.

[57] ABSTRACT

A coin collection apparatus for use with self-service car washing equipment includes a coin meter located at a car wash bay and a coin collection box located remote therefrom which is inaccessible to the public. A conduit extends generally between the coin meter and collection box. A pump motor applies a vacuum to the conduit for conveying coins deposited in the meter into the collection box. A switch integrated with the coin meter for controlling car washing equipment located at the wash bay has a plurality of discrete equipment actuation positions. A dial rotatably mounted on the coin meter is used to manually actuate the switch. An electrical circuit operatively connects the switch and motor whereby the motor is actuated upon deposit of a predetermined amount of coins into the meter and the switch is moved to the predetermined equipment actuation positions. A vault houses the coin collection box which is pivotally mounted therein to facilitate removal of the coins therefrom.

11 Claims, 3 Drawing Sheets

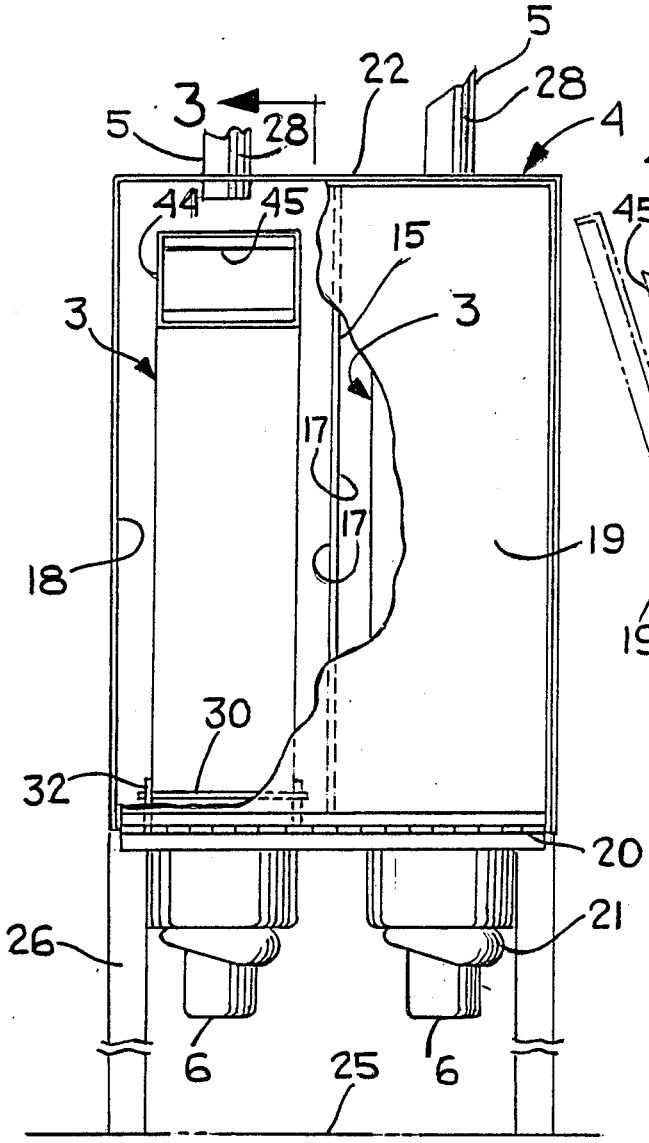
3 ← FIG. 2
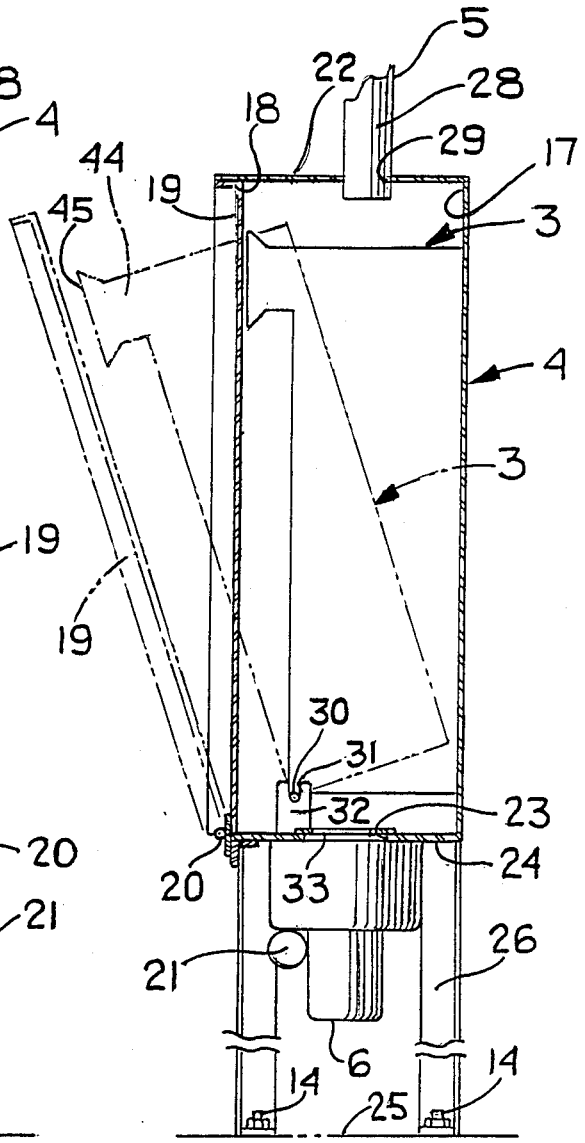
FIG. 3
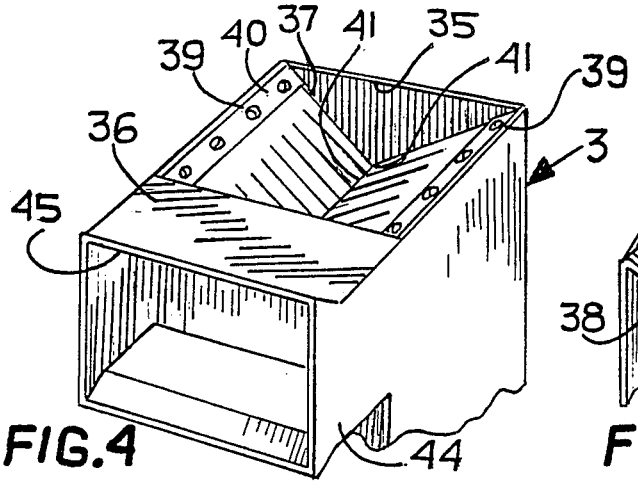
FIG.4
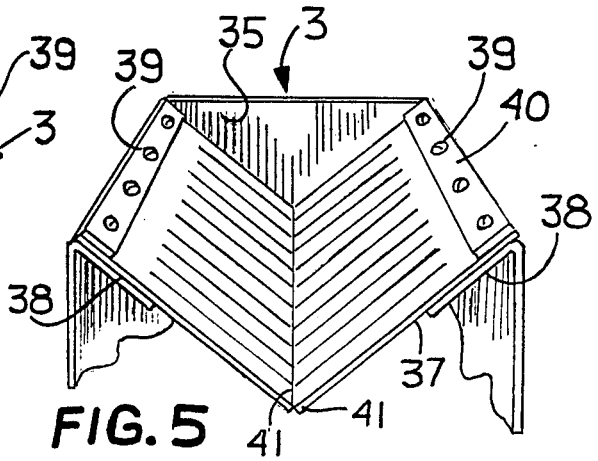
FIG. 5

VACUUM COIN COLLECTION APPARATUS

TECHNICAL FIELD

The invention relates to the pneumatic conveying of articles and in particular to the pneumatic conveying of coins from a meter in a car wash bay into a secure collection box. More particularly, the invention relates to such a coin collection apparatus in which a manually actuated switch for controlling car washing equipment in the wash bay actuates a vacuum pump upon movement of the switch to a selected one of a plurality of equipment actuation positions to draw the coins from the meter into the collection box.

BACKGROUND ART

Self-service car cleaning businesses have increased in popularity in recent years due to several factors. One such factor is the desire of vehicle owners to wash, polish and otherwise clean their cars, trucks, vans, etc. more easily, quickly and efficiently than is possible by traditional hand-cleaning methods. Also, many self-serve car wash locations provide cleaning functions in addition to the wash, rinse and wax cycles commonly found at most locations. These additional functions include tire and engine cleaning, underbody spray, etc., which procedures are too difficult or inconvenient for many vehicle owners to perform at their homes. Most importantly, the self-serve car wash provides a basic car washing service to those individuals who do not have the means available to them at their dwellings to adequately clean their cars, such as an outdoor spigot and hose or a sheltered place such as a garage for cleaning the vehicle during inclement weather. Apartment dwellers are the most common example of individuals with such deficiencies.

The typical self-service car wash includes a plurality of car wash bays, each having its own car washing equipment therein. Such equipment usually consists of a wand or other similar device capable of performing some or all of the above-mentioned car cleaning procedures. The wand is usually actuated by a customer by depositing a predetermined amount of coins into a meter located in the wash bay and then manually selectively moving a dial on the meter to various car cleaning functions listed on the face thereof.

Most self-serve car washes are unattended and are located on or adjacent to busy thoroughfares in order to attract the optimum number of customers. During peak traffic periods, large amounts of money are collected in the coin meters. Unfortunately, however, such exposure also attracts thieves intent on stealing the money contained in the coin meters. A thief can quickly break into the meters and make off with the proceeds contained therein. The owner or operator of the car wash can reduce his losses from such thievery by frequently retrieving the money from the meters, but repeated trips to the car wash are time-consuming and often impractical. Thus, the only alternative solution to this problem is to devise a way to automatically remove the coins from the meters and transport them to a secured area for safekeeping until the coins can be retrieved. One way to achieve such automatic removal is by pneumatically conveying the coins from the meters to a secured area by use of either a pump or blower motor.

Several known prior art pneumatic conveying apparatus are shown in U.S. Pat. Nos. 2,003,257; 3,419,209; and 3,509,911. However, the apparatus shown in these patents must either be actuated by an operator, or if user actuated, the pneumatic conveying means is always running which is costly and inefficient.

The closest known prior art to my vacuum coin collection apparatus of the present invention is disclosed in U.S. Pat. No. 4,131,318. However, there are significant differences between the vacuum coin collection apparatus shown in this U.S. Pat. No. 4,131,318 and my coin collection apparatus. First, the apparatus shown in the U.S. Pat. No. 4,131,318 utilizes complicated timing mechanisms to periodically actuate a vacuum motor and solenoids whereby coins are periodically conveyed from each coil meter located in separate car wash bays and into a single remote collection chamber. The timing mechanisms actuate the vacuum motor whether or not coins are present in the coin meter. The apparatus of the present invention uses a simple switch and electrical circuit to actuate the pump motor only when coins have been deposited in the meter for conveying the coins to a remote secure collection box. Furthermore, the apparatus of the type shown in the U.S. Pat. No. 4,131,318 does not remove the coins from the meters immediately upon their deposit. Thus, the possibility exists that the coins still could be pilfered from the meters if a thief strikes between coin removal cycles for a particular meter.

Accordingly, the need exists for an improved, user-actuated vacuum coin collection apparatus, particularly for use in connection with self-service car washing equipment. The need also exists for an improved coin collection apparatus in which coins are removed from the meters immediately upon their deposit therein; in which the motor utilized to convey the coins to a secure area operates only when coins are present in the meters; and in which the apparatus is economical to manufacture, is easily installed in new or existing self-service car wash bays, and is simple and reliable in its construction and operation to avoid excessive "downtime" and increased maintenance and repair costs.

DISCLOSURE OF THE INVENTION

Objectives of the invention include providing an improved coin collection apparatus for use with self-service car washing equipment which provides for automatic conveyance of coins from meters located in individual car wash bays to a secured remote area immediately upon deposit of coins in the meters to prevent theft of the coins therefrom.

Another objective of the invention is to provide an improved coin collection apparatus which is user-actuated, whereby upon deposit of a predetermined amount of coins into the coin meter and manual actuation of a switch to a selected one of several car washing equipment actuation positions, a motor is actuated which applies a vacuum to a conduit and conveys the deposited coins from the meter and into a remote secure collection box. A further objective is to provide such an apparatus in which the motor runs only when coins are deposited in the meters.

A still further objective of the invention is to provide an improved coin collection apparatus which is reliable and simple in its construction and operation, and which can be easily installed in either an existing or new self-service car wash facility.

Still another objective of the invention is to provide an improved coin collection apparatus in which the coins may be quickly and easily retrieved from the coin collection box by manually pivoting the box downwardly outwardly through an excess opening of a vault in which the box is securely housed, whereby the coins slide out of an outlet opening formed in the collection box and into a transportable receptacle.

A further objective of the invention is to provide an improved coin collection apparatus in which a pair of gates extend across an inlet opening formed in the coin collection box to decrease the velocity of coins entering the box from the conduit to prevent marring of the interior surfaces of the collection box and ejection of ricocheting coins therefrom.

These objectives and advantages are obtained by the improved vacuum coin collection apparatus of the invention, the general nature of which may be stated as including, a coin meter located at a car wash bay; a coin collection box formed with a coin-receiving chamber located remote from the car wash bay; a conduit extending generally between the coin meter and coin collection box; means for applying a vacuum to the conduit for conveying a coin deposited in the coin meter into the collection chamber; manually actuated switch means for controlling car washing equipment located at the wash bay, said switch means having a plurality of discrete equipment actuation positions; and means for operatively connecting the switch means and vacuum means whereby the vacuum means is actuated upon deposit of a predetermined amount of coins into the coin meter and movement of the switch means to a selected one of the equipment actuation positions.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 2 is a fragmentary front elevational view with portions broken away, of the coin receiving vault, particularly showing the arrangement of the coin collection boxes therein and the motors mounted thereon;

FIG. 3 is a fragmentary sectional view taken on line 3—3, FIG. 2, particularly showing in dot-dash lines the vault door and coil collection box in a partially open position and pivoted partially outwardly downwardly toward the coil retrieval position;

FIG. 4 is a fragmentary perspective view of the top portion of the coin collection box, showing the outlet opening and the gates which extend across the inlet opening;

FIG. 5 is a fragmentary front elevational view similar to FIG. 4 of the top portion of the coin collection box, showing the mounting of the inlet opening gates thereon.

Similar numerals refer to similar parts throughout the drawings.

BEST MODE FOR CARRYING OUT THE INVENTION

Figure 1:
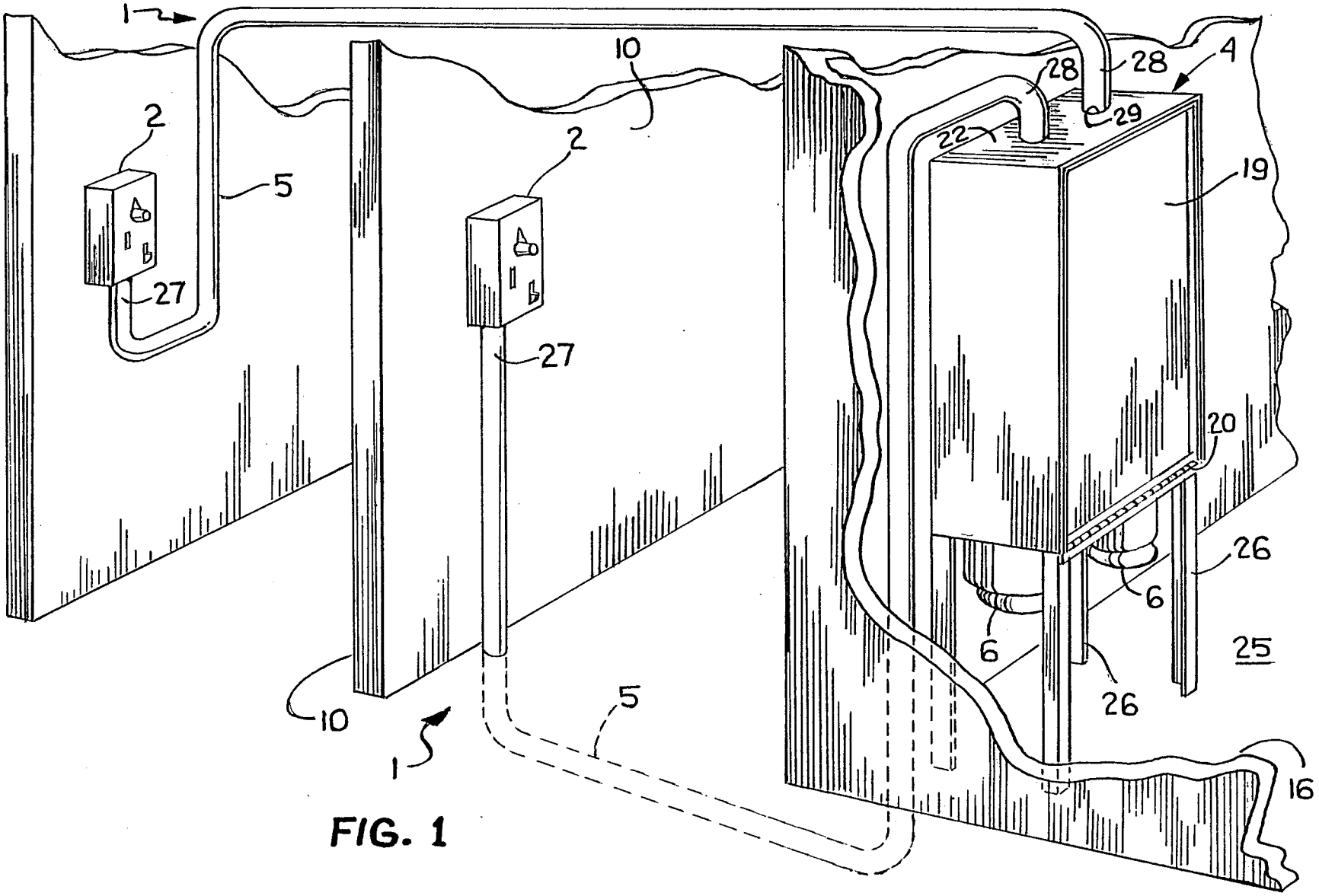
FIG. 1 is a fragmentary perspective view with portions broken away of the vacuum coin collection apparatus of the present invention, installed in a self-service car wash.
Figure 6:
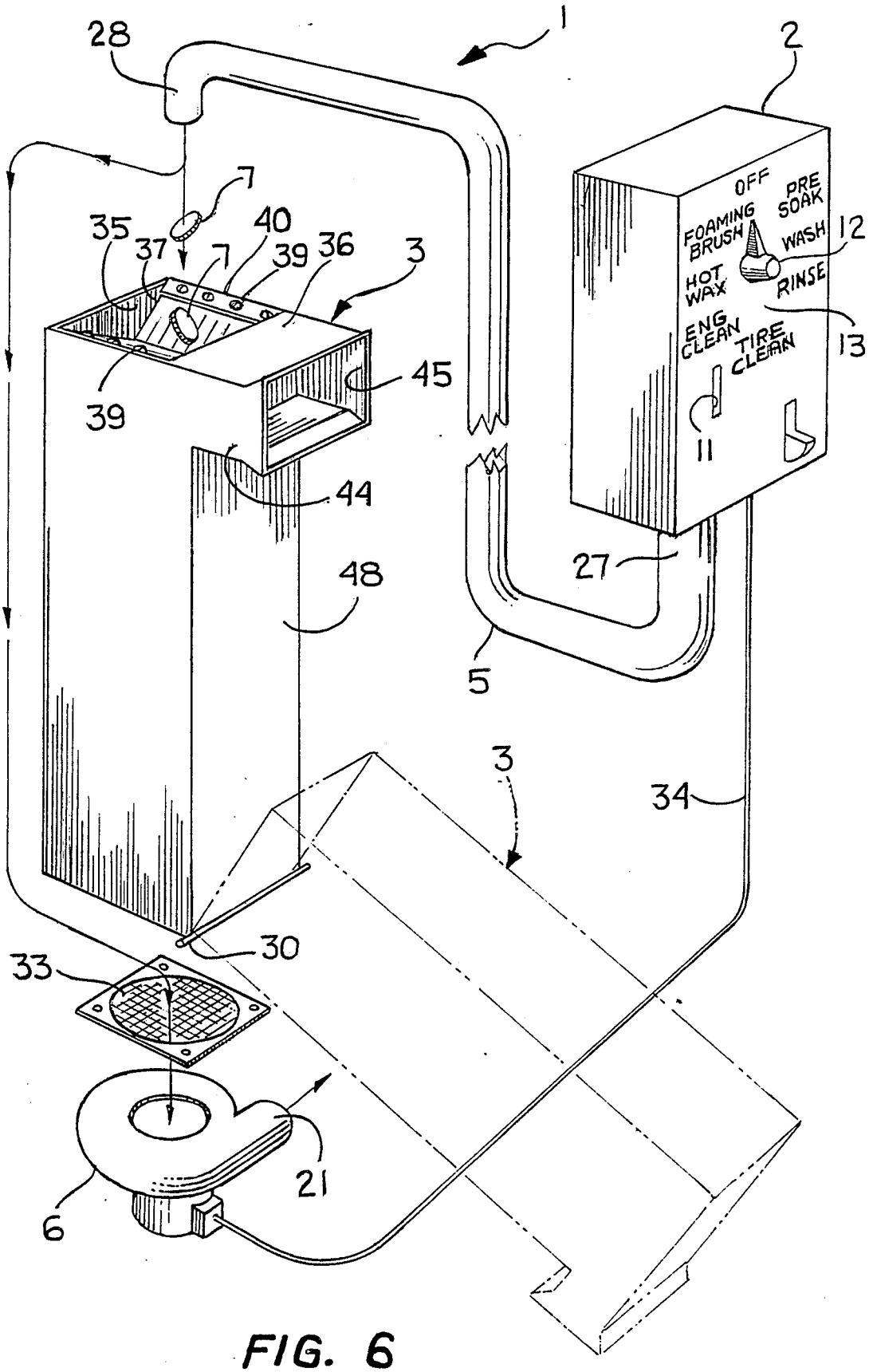
FIG. 6 is a fragmentary diagrammatic view of the coin meter, collection box, pump motor, and connecting conduit, and the electrical circuit which operatively connects the meter and pump motor, and further showing in dot-dash lines the collection box in its downwardmost coin retrieval position.

The improved vacuum coin collection apparatus of the invention is indicated generally at 1, and is shown particularly in FIGS. 1 and 6. Vacuum coin collection apparatus 1 includes a coin meter 2, a coin collection box indicated generally at 3, a vault indicated generally at 4 which houses the collection box, a conduit 5 which extends generally between the coin meter and collection box, and a pump motor 6 for applying a vacuum to the conduit for conveying coins 7 deposited in the coin meter into the collection box.

A typical self-service car wash includes a plurality of car wash bays 10 (FIG. 1), each of which may be equipped with one of the improved vacuum coin collection apparatus of the invention. However, only one of the coin collection apparatus will be described in detail herein, since the structure and function of each of the apparatus is similar.

Coin meter 2 of collection apparatus 1 is mounted in one of the wash bays 10 of a self-service car wash installation (FIG. 1). The specific details of coin meter 2 are conventional and, therefore, are described only briefly herein. Coin meter 2 has a coin deposit slot 11 formed therein and a selection dial 12 rotatably mounted thereon (FIG. 6.). A user of the car wash inserts a predetermined amount of coins into slot 11 depending on the cleaning function or functions desired. He or she then selects the desired cleaning function by rotating dial 12 to the appropriate position, as indicated on a face 13 of coin meter 2. Preferably, the available functions include pre-soak, wash, foaming brush, rinse, tire clean, engine clean, and hot wax, though more functions can be included or some excluded without effecting the concept of the invention.

Vault 4 securely houses coin collection box 3 in a secured room 16 (FIG. 1) of the car wash remote from wash bays 10 and inaccessible to the public. The vault is rectangular-shaped, preferably formed of a sturdy metal, and is generally airtight to provide an environment conducive to the creation of the vacuum within conduit 5. Vault 4 may house two collection boxes 3, as shown in the drawings. However, the vault can be designed to house only one or several of the boxes without effecting the concept of the invention. A vertical wall 15 divides the interior of vault 4 into two independent generally airtight chambers 17, with each of the two collection boxes 3 being mounted within a respective one of the chambers 17. An access opening 18 (FIG. 2) is formed in the vault and a door 19 is hingedly mounted thereon by hinge 20 for selectively opening and closing the access opening.

Pump motor 6 of coin collection apparatus 1, is mounted adjacent an opening 23 (FIG. 3) formed in a bottom wall 24 of vault 4 and communicates with one of the chambers 17 formed therein. A screen 33 (FIGS. 4 and 6), is mounted on bottom wall 24 of the vault and extends across opening 23 to prevent stray coins and other debris from entering motor 6 and causing possible damage thereto. The motor is operatively connected by an electrical circuit 34 to a switch (not shown) which is integrated with coin meter 2 and manually controlled by selection dial 12. Vault 4 is maintained in an elevated position off of ground 25 by a plurality of legs 26 to provide clearance for the mounting of motor 6 and for the opening of door 19 to empty the contents of collection boxes 3, as described below. The vault is secured to the ground by a plurality of bolts 14 which pass through legs 26 and into the ground, which preferably is formed of cement or the like.

Conduit 5 is formed of any suitable piping or tubing, such as rigid plastic or metal, and as shown in FIG. 1, traverses the distance between the wash bay and the vault either above ground or underground. A first end 27 of conduit 5 is connected to an opening (not shown) formed in coin meter 2 below coin deposit slot 11. A second end 28 of the conduit passes through an opening 29 formed in a top wall 22 of vault 4. Thus, a generally airtight environment exists between vault chamber 17 and first end 27 of the conduit into which coins drop by gravity after their deposit in slot 11. Pump motor 6 pumps air from chamber 17 and conduit 5 out of motor exhaust 21 to create a vacuum within the conduit for conveying coins 7 therethrough and into collection box 3.

Coin collection box 3 preferably is formed of a sturdy metal and has an elongated rectangular shape and forms a collection chamber therein. The box is pivotally mounted within one of the chambers 17 of vault 4 by a horizontally extending shaft 30 which is attached to the front bottom portion of the collection box (FIGS. 2, 3 and 6). Each end of shaft 30 is pivotally mounted in a respective one of a pair of U-shaped slots 31 formed in a pair of lugs 32 which extend upwardly from bottom wall 24 of the vault. This arrangement allows the collection box to be manually emptied by one person without removal of the collection box from the vault, as will be described in the description of the operation of the collection apparatus below. An inlet opening 35 (FIGS. 4 and 5) is formed in a top wall 36 of collection box 3, and is positioned directly below second end 28 of conduit 5 for receiving coins 7 conveyed by motor 6 into the collection chamber. A frontward extension 44 formed on the top portion of box 3 has a flanged outlet opening 45 formed therein (FIGS. 4 and 6) for retrieval of the collection coins therefrom.

A pair of rectangular-shaped gates 37 extend across inlet opening 35 for reducing the velocity of the coins 7 entering the collection box (FIGS. 4, 5 and 6). Each gate 37 preferably is formed of an elastomeric material and is mounted on a respective one of a pair of inwardly downwardly extending portions 38 of top wall 36 by a plurality of rivets 39 which pass through a mounting plate 40, gate 37, and inwardly extending portion 38. A slitted longitudinal edge 41 of each of the gates abuts the slitted edge of the other gate to allow passage of coins 7 through inlet opening 35 of the collection box while preventing marring of the interior surface of the collection box and possible ejection of ricocheting coins therefrom.

The improved vacuum coin collection apparatus 1 of the present invention is operated in the following manner. The user of the apparatus deposits a predetermined amount of coins into the coin meter deposit slot, which amount depends on the cleaning function or functions he or she desires from the car washing equipment. Selection dial 12 then is rotated to the appropriate equipment actuation position which automatically actuates the equipment in a usual manner well-known in the art. A plurality of discrete equipment actuation positions are available as shown in FIG. 6 on face 13 of the coin meter and usually will include a presoak, wash, foaming brush, rinse, tire clean, engine clean and hot wax. A selected one of these positions actuates the pump motor when the appropriate amount of coins are deposited in the meter and the dial is rotated to that one selected position.

In accordance with one of the main features of the present invention, a selected one of the equipment actuation positions actuates the pump motor which is connected to the meter by electrical circuit 34. The selected function preferably is the rinse position, since nearly every user of the car wash will use the rinse cycle during the cleaning of his or her vehicle. However, any of the other positions can be used to actuate the motor, although use of a less-used position, such as the engine clean function, could result in coins remaining in the meter for an extended period of time, increasing the risk of theft.

After its actuation, the pump motor pumps air from conduit 5 and chamber 17 of vault 4 and out of exhaust 21 to create a vacuum condition within the conduit and chamber. Any coins deposited in the meter drop by gravity into first end 27 of the conduit and are conveyed by the vacuum through the conduit and out of second end 28 thereof. As the coins exit the second end of the conduit, they impact gates 37. The gates reduce the velocity of the coins to prevent excessive denting and scratching of the interior of the collection box and prevent ejection of ricocheting coins out of inlet opening 35. Should any coins miss opening 35 or ricochet from the collection box, screen 33 prevents the stray coins from entering the motor and causing possible damage.

When it is desired to retrieve the coins from the collection box, door 19, which is secured in the closed position by a lock (not shown) or other similar security device, is hingedly moved to the open position. The box is manually pivoted downwardly outwardly through access opening 18 whereby the coins contained in the chamber formed by the box, slide along front wall 48 thereof, out of the flanged opening and into a transportable receptacle such as a cloth money bag or the like. Frontward extension 44 and the flanged configuration of opening 45 facilitate the placement of such a receptacle over the opening to prevent coins from dropping to the ground during emptying of the box.

In summary, the improved coin collection apparatus of the invention provides a simple, reliable, user-actuated means for automatically conveying coins from the coin meters in the wash bays to a remote secure area of the car wash facility for safekeeping. The coins are conveyed from the meter almost immediately upon their deposit therein by movement of the selection dial to a predetermined one of the cleaning function positions which actuates the pump motor as well as the associated car washing equipment. The coins are conveyed to the collection box and are quickly and easily removed therefrom by authorized personnel by manually pivoting the box downwardly outwardly through the access opening of the vault. Both the secured remote room and the vault located therein provide protection against theft of the coins.

The pivotal mounting of the collection box within the vault and the flanged opening formed in the box make it possible for one person to empty the coins from the collection chamber into a suitable transportable container for deposit of the money in the bank, etc. Thus, the owner or operator of the self-service car wash facility can allow proceeds from the operation of the car wash to remain uncollected for extended periods of time without worry about theft of the coins. As further protection against theft, a sign may be installed on or near the coin meters in the wash bays alerting would-be thieves to the fact that the coins are automatically removed from the meters immediately upon insertion therein to further decrease the probability of theft and resultant damage to the coin meters which accompanies such thefts.

Finally, the apparatus is designed so that the motor runs only when coins are present in the coin meter, eliminating costly operation of the motor when the meter is empty as in some prior art coin collection apparatus.

Accordingly, the vacuum coin collection apparatus of the invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved vacuum coin collection apparatus is constructed and used, the characteristics of the construction, and the advantageous, new and useful results obtained; the new and useful structures, devices, elements, arrangements, parts, and combinations, are set forth in the appended claims.

What is claimed is:

1. A coin collection apparatus for use with self-service car washing equipment, including:

(a) a coin meter located at a car wash bay;

(b) a coin collection box formed with a coin-receiving chamber located remote from the car wash bay;

(c) a conduit extending generally between the coin meter and coin collection box;

(d) means for applying a vacuum to the conduit for conveying a coin deposited in the coin meter into the collection chamber;

(e) manually actuated switch means for controlling car washing equipment located at the wash bay, said switch means having a plurality of discrete equipment actuation positions; and (f) means for operatively connecting the switch means and vacuum means whereby the vacuum means is actuated upon deposit of a predetermined amount of coins into the coin meter and movement of the switch means to a selected one of the equipment actuation positions.

2. The apparaus defined in claim 1 in which a slot is formed in the coin meter to receive coins deposited therein; and in which a first end of the conduit is connected to an opening formed in said coin meter below the coin slot.

3. The apparatus defined in claim 2 in which a generally airtight vault houses the coin collection box.

4. The apparatus defined in claim 3 in which the vault is generally rectangular-shaped and has an access opening formed therein; in which a door is hingedly mounted on said vault for selectively opening and closing the access opening; and in which a second end of the conduit passes through a first opening formed in a top wall of the vault.

5. The apparatus defined in claim 4 in which the coin collection box is generally rectangular-shaped and is pivotally mounted in the vault; in which a coin inlet opening is formed in a top wall of said collection box and is positioned below the second end of the conduit; and in which a flanged coin outlet opening is formed in the upper portion of a front wall of the collection box adjacent the access opening of said vault, whereby coins are retrieved from the collection chamber by manually pivoting said collection box downwardly outwardly through the access opening to slide the coins out of the collection box through said flanged opening and into a transportable receptacle.

6. The apparatus defined in claim 5 in which gate means extends generally across the collection box inlet opening for reducing the velocity of coins entering the collection box to prevent damage to said collection box and ejection of coins therefrom.

7. The apparatus defined in claim 6 in which the gate means is a pair of rectangular-shaped elastomeric gates mounted on the top wall of the collection box; and in which a plurality of slits are formed in adjacent ends of said gates providing for passage of coins therethrough.

8. The apparatus defined in claim 5 in which the means for applying a vacuum to the conduit is a pump motor.

9. The apparatus defined in claim 8 in which the pump motor is mounted adjacent a second opening formed in a bottom wall of the vault.

10. The apparatus defined in claim 1 in which the switch means is a switch controlled by a dial rotatably mounted on the coin meter.

11. The apparatus defined in claim 1 in which the means for operatively connecting the switch means and vacuum means is an electrical circuit.

* * * * *